United States Patent [19]

Benke

[11] 4,174,837

[45] Nov. 20, 1979

[54] DRUG DISPENSING APPARATUS FOR A HUNTING ARROW

[76] Inventor: Gus A. Benke, Rte. 9, Box 850, San Antonio, Tex. 78227

[21] Appl. No.: 887,187

[22] Filed: Mar. 16, 1978

[51] Int. Cl.[2] ..... F41B 5/02

[52] U.S. Cl. ..... 273/106.5 R

[58] Field of Search ..... 273/106.5 R, 106.5 B, 273/106.5 D; 43/6; 128/215

[56] References Cited

U.S. PATENT DOCUMENTS

| | | | |
|---|---|---|---|
| 3,066,940 | 12/1962 | De Lonais | 273/106.5 B |
| 3,457,921 | 7/1969 | Waldeisen | 128/215 |
| 3,565,435 | 2/1971 | Bear | 273/106.5 R |
| 3,572,716 | 3/1971 | Bear | 273/106.5 R |
| 3,893,866 | 7/1975 | Hollingsworth | 273/106.5 B X |

*Primary Examiner*—Paul E. Shapiro

*Attorney, Agent, or Firm*—Gunn & Lee

[57] ABSTRACT

A drug dispensing apparatus is provided for use with an arrow for hunting animals. The apparatus includes a center cylinder slideably receiving the shank of the arrow therethrough. The trailing edge of the center cylinder has outwardly extending flange hooks to retain the center cylinder near the surface of the animal upon penetration by the arrowhead. An outer cylinder encircles the center cylinder and forms a sealed annular recess therebetween, which recess receives a drug therein. The forward portion of the outer cylinder has an inwardly extending flange rigidly secured between the shank and the arrowhead. As the arrowhead penetrates the animal, the outer cylinder follows the arrowhead leaving the center cylinder and drug contained in the annular recess in the surface tissue of the animal.

7 Claims, 6 Drawing Figures

DRUG DISPENSING APPARATUS FOR A HUNTING ARROW

BACKGROUND OF THE INVENTION

The present invention relates to arrows used in game hunting and, more particularly, to an apparatus that releases a drug in the muscular surface portion of the animal upon impact. As background information on a drug that can be used, succinylcholine chloride (diacetylcholine chloride), hereinafter referred to as the "drug", is a fast acting, relatively powerful muscle relaxant. The drug has been used in bow and arrow hunting to make the bow and arrow a more humane weapon for hunting purposes. The drug, in a powdered or crystalling form, is highly stable; however, when the drug is introduced into the animal's circulatory system, an enzyme (serum cholinesterase) hydrolyzes the compound into succinic acid and choline, both of which are normal body constituents.

It has further been found that the commonly hunted game animals, such as deer, are approximately thirty times more sensitive to the drug than man. Therefore, if a drug holding device is highly efficient, it is possible to use a dosage that is humanely effective for most hunting purposes, yet is harmless to the hunter should he be accidentally shot with the arrow.

The applicant, through extensive research and testing, particularly while collecting whitetail deer with bow and arrow, has found the drug to be most effective when released in muscle tissue and organs within the thoracic cavity. However, if the drug is released within the abdominal cavity, response to the drug is often very slow, incomplete and/or transitory. By the use of dye release studies, it was found that prior drug dispensing devices release the bulk of the drug along the penetration route of the arrow. Arrows that were affixed with prior drug dispensing devices immediately adjacent to the arrowhead would therefore release the bulk of the drug in the stomach and/or intestinal contents in the case of abdominal wounds. In such wounds much of the dosage becomes bound within digestive matter and is effectively segregated from tissue through which it can be absorbed into the circulatory system. The partial and gradual absorption of the drug results in inadequate responses.

In the hunting of deer with bow and arrow, the weapon's inherent limitations are such that many deer are inadvertently struck in the abdominal cavity. In such wounds, the arrow will likely penetrate the stomach and/or intestines. Therefore, with prior drug holding devices, the drug would be released in the above described manner and would result in undesirable responses.

In experimenting with the present invention hereinafter described, applicant has found through dye release studies of deer carcasses that the present device releases the bulk of its dosage within a confined area of approximately one inch radius around the point of penetration of the arrow. In abdominal wounds, dye release studies further show that the bulk of the dosage is in contact with the peritoneal muscles, the peritoneum and the mucous membrane (hereinafter collectively referred to as "surface tissue") of the initially pierced digestive organ. This release insures rapid absorption and disbursal of the drug into the circulatory system of the animal. By using the present invention which more efficiently dispenses its dosage, a lesser amount of drug may be used to achieve satisfactory results. While only one drug was mentioned hereinabove, other suitable drugs may be used with the present apparatus in the hunting of game and nongame animals.

BRIEF DESCRIPTION OF THE PRIOR ART

Drugs or poisons in the hunting of animals have long been used by more primitive societies. Even today the principle of poison darts is used in guns that fire darts containing some type of drug or immobilizing substance therein. A typical such immobilization dart is shown in U.S. Pat. No. 3,457,921, which dart may be fired from an air gun.

In recent years, the popularity of bow and arrow hunting has increased among sportsmen. However, today's bow and arrow hunter does not have the skill of the hunters of yesteryear. Furthermore, the inadequacy of conventional archery equipment for hunting purposes has not been fully recognized by the public. As a result many animals are mortally wounded by arrows each year, yet flee to remote locations and die. In several states, game laws do not prohibit the use of arrows equipped with drug loading devices. Consequently, there has been increased usage of such arrows. A typical arrow is shown in U.S. Pat. No. 3,066,940 wherein a capsule is ruptured upon impact for dispensing a fluid drug by the arrowhead. The fluid drug is dispensed along the path of penetration of the arrowhead.

Another type of drug dispensing hunting arrow is shown in U.S. Pat. No. 3,565,435 wherein a flexible sheath is stripped back as the arrow penetrates the tissue of an animal. By stripping back the flexible sheath, the immobilizing drug is dispensed along the path of penetration.

Another method of dispensing a drug by arrow is shown in U.S. Pat. No. 3,893,866 wherein a sleeve member slideably telescopes along the shank of the arrow as the arrow penetrates the animal thereby releasing the drug along the path penetrated by the arrow.

All of the above described devices release their dosage in a common manner. In the case of abdominal wounds, these devices generally release the bulk of their dosages within the contents of penetrated digestive organs. As discussed, such release results in only partial absorption of the dosage.

SUMMARY OF THE INVENTION

It is an object of the present invention to provide an apparatus for use with an arrow for bow and arrow hunting, which apparatus will dispense a drug in the muscle or surface tissue of an animal upon impact.

It is another object of the present invention to provide an arrow with a drug dispensing apparatus wherein the drug remains in contact with the surface tissue of the animal even though the arrow may penetrate considerably beyond the surface tissue.

A drug retaining capsule is provided wherein the capsule has a center cylinder with raised annular rings for forming an annular recess therebetween. A center opening of the center cylinder is designed to receive a shank of an arrow therethrough. A rear portion of the center cylinder has outwardly and forwardly extending flange hooks for attaching to the surface of the animal upon penetration by the center cylinder into the surface tissue of an animal. An outer cylinder slideably seals with the raised annular rings to form an annular recess therebetween, which annular recess contains a suitable drug for use in hunting animals. A forward portion of the outer cylinder forms an inwardly extending flange for securing between the arrowhead and the shank of the arrow. As the arrowhead penetrates the animal, the inwardly extending flange pulls the outer cylinder into the animal with the arrowhead. However, the hooks retain the center cylinder in the surface tissue thereby causing the outer cylinder to slideably unseal the annular recess and the drug contained therein in the surface tissue. The outwardly extending flange hooks secure the center cylinder at the surface of the animal despite movement of the animal for continued dispensing of the drug in the surface tissue of the animal.

DESCRIPTION OF THE PREFERRED EMBODIMENT

Figure 1:
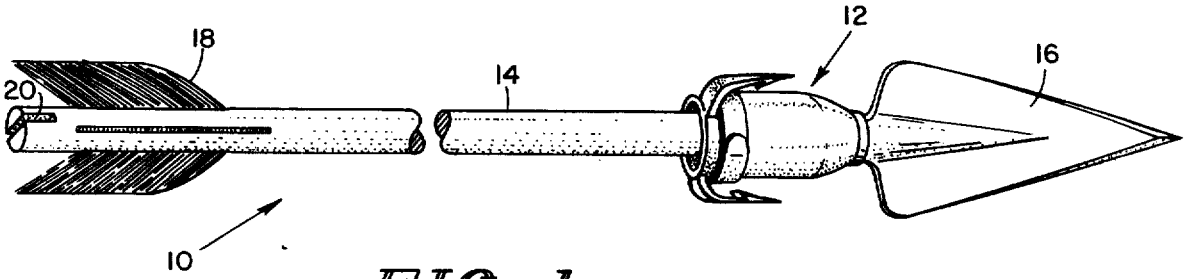
FIG. 1 is a perspective view of an arrow having a drug dispensing device mounted thereon.

Referring to FIG. 1 of the drawings, there is shown an arrow represented generally by reference numeral 10, which arrow 10 has the present drug dispensing apparatus 12 mounted thereon between the shank 14 and arrowhead 16. The arrowhead 16 shown is of the "broad head" type, but could be any other suitable type arrowhead. The rear portion of the shank 14 has radially extending fins 18 for guiding the arrow 10, which radially extending fins 18 may be made from feathers or plastic. A slot 20 in the rear of the shank 14 is for receiving the bow string in a conventional manner.

Figure 2:
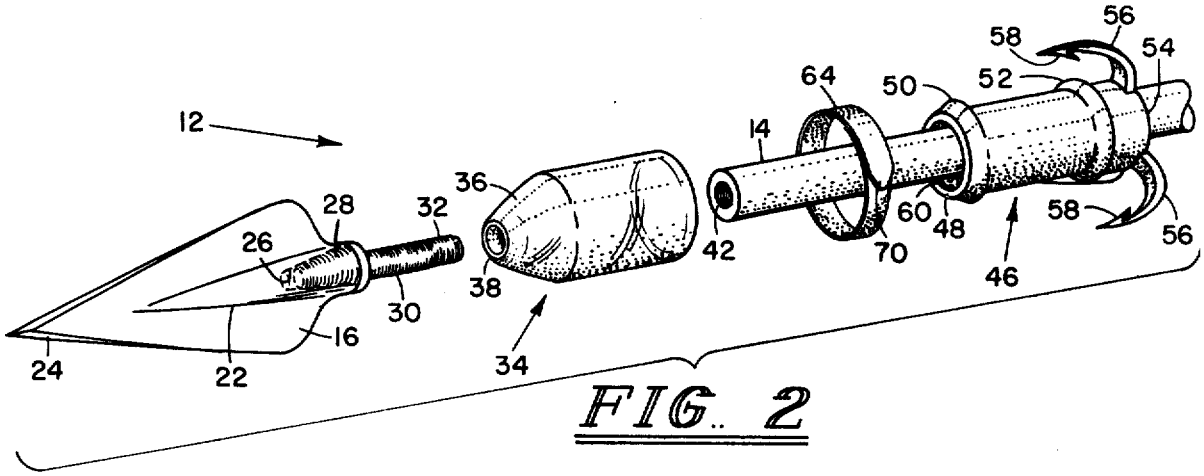
FIG. 2 is an exploded perspective view of the forward portion of the arrow shown in FIG. 1.

Referring now to the exploded perspective view of FIG. 2, the drug dispensing apparatus 12 is shown in more detail. The arrowhead 16 has a sharpened forward edge 24 for penetrating the animal, and an enlarged conically shaped center portion 22 toward the rear thereof. The enlarged conically shaped center portion 22 has a frusto-conical recess 26 in the rear thereof for receiving the threaded frusto-conical end 28 of mounting shank 30. On the opposite end of mounting shank 30 is a threaded portion 32 for threadably connecting into interval threads 42 of shank 14. The arrow 10 may be assembled with or without the drug dispensing apparatus 12 by threadably connecting the threaded portion 32 of the mounting shank 30 with shank 14, and by securing the arrowhead 16 on the threaded frusto-conical end 28.

Figure 3:
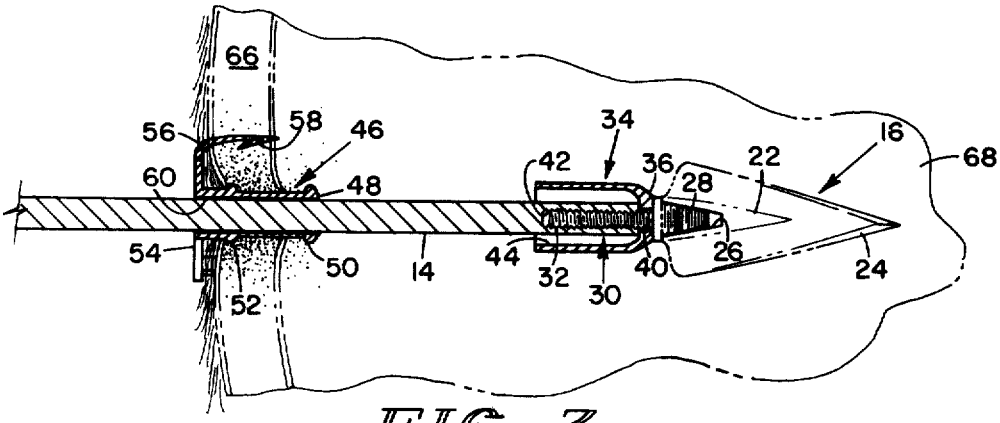
FIG. 3 is a cross-sectional view of the forward portion of the arrow shown in FIG. 1 after penetration by the arrow into the abdominal region of an animal to illustrate disbursal of a drug from the drug dispensing apparatus.

Referring to FIGS. 2 and 3 in combination, a better understanding of the drug dispensing apparatus 12 can be obtained. An outer cylinder 34 has an inwardly extending forward flange 36 that terminates in forward opening 38. Forward opening 38 is just large enough to receive the mounting shank 30 therethrough, but not large enough to receive shank 14 of arrow 10 therethrough. Therefore, the inwardly extending forward flange 36 is wedged between shoulder 40 of the mounting shank 30 and shank 14 as can be seen in FIG. 3. The threaded portion 32 of mounting shank 30 is threadably connected to internal threads 42 of shank 14.

The rear of outer cylinder 34 has opening 44 for receiving inner cylinder 46 therein. Opening 44 is designed to receive the forward end 48 of the inner cylinder 46 inside of outer cylinder 34 so that forward and rear annular rings 50 and 52, respectively, will seal with the internal portion of the outer cylinder 34. To accomplish the sealing necessary between the annular rings 50 and 52 and the inner portion of outer cylinder 34, a degree of flexibility is necessary, which flexibility can be obtained by any of a number of methods. One method would be to have either or both the outer cylinder 34 and the inner cylinder 46 manufactured from a suitable plastic material that has sufficient strength yet is pliable enough to slideably seal therebetween.

The rear 54 of the inner cylinder 48 has a plurality of outwardly and forwardly extending members 56 with a hook 58 on the outward and forward tip thereof. The center opening 60 of the inner cylinder 46 is large enough to freely receive the shank 14 of arrow 10 therethrough.

Figure 5:
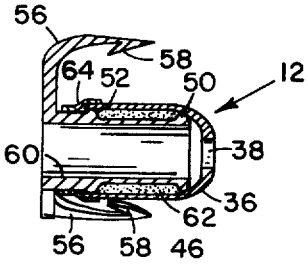
FIG. 5 is a cross-sectional view of FIG. 4 along section lines 5—5.
Figure 4:
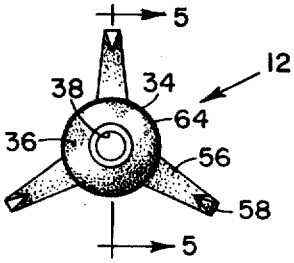
FIG. 4 is a front view of the drug dispensing apparatus.
Figure 6:
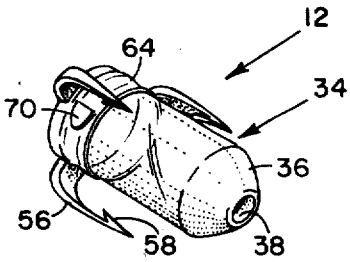
FIG. 6 is a perspective view of the drug dispensing apparatus shown in FIG. 4.

Referring now to the drug dispensing apparatus 12 as shown separately in FIGS. 4, 5 and 6, the assembly of the drug dispensing apparatus 12 as a separate component is shown in more detail. As the outer cylinder 34 securely seals with annular rings 50 and 52 of the inner cylinder 46, a drug is inserted in annular space 62 therebetween. To insure that the outer cylinder 34 is not accidentally separated from the inner cylinder 46 thereby spilling the drug from the annular space 62, a retaining band 64 is secured around opening 44 of the outer cylinder 34. By use of the retaining band 64 that will shrink fit, the outer cylinder 34 may be securely fastened to the inner cylinder 46 by a positive retaining force. By pulling on tab 70, the retaining band 64 may be removed prior to use of the arrow 10.

Referring now to FIG. 3 of the drawings, there is shown an environmental view of the arrow 10 upon penetration in the abdominal region of an animal. The arrowhead 16 has penetrated through the surface tissue 66 into the abdominal region 68 of the animal. As the arrowhead 16 penetrates through the surface tissue 66, hooks 58 of outwardly and forwardly extending members 56 of inner cylinder 46 attach to the surface tissue 66. As the arrowhead 16 penetrates into the abdominal region 68 by its inertia force, the outwardly and forwardly extending members 56 cause the inner cylinder 46 to remain in the surface tissue 66 thereby slideably unsealing from the outer cylinder 34. The outer cylinder 34, because of the forward flange 36 being retained between shaft 14 and shoulder 40, will continue to move forward with the arrowhead 16. The forward end 48 of the internal cylinder 46 will penetrate into the surface tissue 66 and the hooks 58 will retain the rear 54 of inner cylinder 46 at the point of penetration of the arrowhead 16. Also, hooks 58 will prevent the inner cylinder 46 from retracting from the surface tissue 66 upon subsequent movement of the animal.

Because the inner cylinder 46 remains imbedded in the surface tissue 66 and annular rings 50 and 52 slideably rub along the internal portion of outer cylinder 34, the bulk of the drug contained in annular ring 62 is deposited in the surface tissue 66 thereby allowing for quicker and more complete entry of the drug into the circulatory system of the animal. The bulk of the drug being deposited in the absorptive tissue of the animal and not in the abdominal region 68 in a significant advantage over previous devices. By use of a drug dispensing apparatus 12 as shown and described, a much faster reaction time to the drug is obtained. With the invention as just described, applicant has experimentally determined that an animal can be immobilized within a matter of seconds even in cases of abdominal wounds whereas prior drug devices may require several minutes after impact to become effective during which time the animal has fled a considerable distance.

By use of the drug dispensing apparatus 12 as described and shown in FIGS. 4, 5 and 6, convention arrows may be reused time and again with only the drug dispensing apparatus being either replaced by a disposable or refilled cartridge. By use of the invention as described, a mass produced drug dispensing apparatus 12 can be economically manufactured in a disposable form.

I claim:

1. A drug dispensing apparatus for use in hunting animals with a bow and arrow, said arrow having an arrowhead releasably secured to a forward end of a shank, said drug dispensing apparatus comprising:

center cylinder means having a central opening along a longitudinal axis thereof for slideably receiving said shank therethrough, said center cylinder means having at least one outwardly extending flange along a trailing end thereof;

outer cylinder means with means for securing on a forward end thereof to said arrow at said arrowhead, a rear end of said outer cylinder means slideably receiving and sealing with said center cylinder means to define a space therebetween, said space having a drug therein for immobilizing said animal upon impact.

2. The drug dispensing apparatus as given in claim 1 wherein said means for securing includes an inwardly directed forward flange which may be held between said shank and said arrowhead upon assembly with an arrow.

3. The drug dispensing apparatus as given in claim 1 wherein said center cylinder means includes means for sealing with said outer cylinder means in said defining of said space therebetween, said sealing means being carried by said center cylinder means.

4. The drug dispensing apparatus as given in claim 3 wherein said sealing means includes annular rings on said center cylinder means with said space therebetween being generally annular space between said annular rings.

5. The drug dispensing apparatus as given in claim 1 wherein said outwardly extending flange has forwardly extending hook means near outer extremity thereof.

6. The drug dispensing apparatus as given in claim 1 having secondary sealing means for temporarily securing said outer cylinder means to said inner cylinder means.

7. The drug dispensing apparatus as given in claim 6 wherein said secondary sealing means is a removable preshrunk band overlapping said rear end of said outer cylinder means and said center cylinder means.

* * * * *